US012259188B2

(12) United States Patent
Nakata et al.

(10) Patent No.: US 12,259,188 B2
(45) Date of Patent: Mar. 25, 2025

(54) HEAT EXCHANGER

(71) Applicant: FUJITSU GENERAL LIMITED, Kanagawa (JP)

(72) Inventors: Shohei Nakata, Tokyo (JP); Masatoshi Watanabe, Tokyo (JP); Yoshinari Maema, Tokyo (JP); Daiki Shimano, Tokyo (JP); Kotaro Oka, Tokyo (JP)

(73) Assignee: FUJITSU GENERAL LIMITED, Kanagawa (JP)

( * ) Notice: Subject to any disclaimer, the term of this patent is extended or adjusted under 35 U.S.C. 154(b) by 238 days.

(21) Appl. No.: 17/790,871

(22) PCT Filed: Sep. 30, 2020

(86) PCT No.: PCT/JP2020/037356
§ 371 (c)(1),
(2) Date: Jul. 5, 2022

(87) PCT Pub. No.: WO2021/149306
PCT Pub. Date: Jul. 29, 2021

(65) Prior Publication Data

US 2023/0024558 A1 Jan. 26, 2023

(30) Foreign Application Priority Data

Jan. 22, 2020 (JP) ..... 2020-008594

(51) Int. Cl.
*F28D 1/04* (2006.01)
*F28D 1/047* (2006.01)
(Continued)

(52) U.S. Cl.
CPC ..... *F28D 1/047* (2013.01); *F28D 2001/0273* (2013.01); *F28D 2021/0068* (2013.01)

(58) Field of Classification Search
CPC ..... F28D 2001/0273; F28D 2021/0068; F28D 1/047; F28D 1/0471; F28D 1/05391; F28F 9/0209; F28F 9/0275
See application file for complete search history.

(56) References Cited

U.S. PATENT DOCUMENTS 10,436,514 B2 10/2019 Higashiiue et al.
10,465,924 B2 11/2019 Jindou et al.
(Continued)

FOREIGN PATENT DOCUMENTS

CN 1820176 A 8/2006
CN 102378892 A 3/2012
(Continued)

OTHER PUBLICATIONS

Jan. 12, 2024, European Search Report issued for related EP Application No. 20914898.0.
(Continued)

*Primary Examiner* — Tho V Duong
(74) *Attorney, Agent, or Firm* — Paratus Law Group, PLLC

(57) ABSTRACT

A heat exchanger includes an inlet header in which a first inlet space and a second inlet space are formed, a plurality of first inlet-side heat exchanger tubes that are connected to the first inlet space, a plurality of second inlet-side heat exchanger tubes that are connected to the second inlet space, a return header in which a plurality of first return spaces connected to the first inlet-side heat exchanger tubes, respectively, and a plurality of second return spaces connected to the second inlet-side heat exchanger tubes, respectively, are formed, and a plurality of outlet-side heat exchanger tubes that are connected to the first and second return spaces, respectively, wherein a communication path that enables a first return space on a bottom side among the first return spaces and a second return space on a top side among the
(Continued)

second return spaces to communicate is formed in the return header.

4 Claims, 8 Drawing Sheets

(51) Int. Cl.
*F28D 1/02* (2006.01)
*F28D 21/00* (2006.01)

(56) References Cited

U.S. PATENT DOCUMENTS

| | | | | |
|---|---|---|---|---|
| 2008/0148746 | A1* | 6/2008 | Yanik | F28D 1/05391 165/174 |
| 2011/0240271 | A1 | 10/2011 | Mross et al. | |
| 2012/0011867 | A1* | 1/2012 | Koons | F28D 1/0443 165/165 |
| 2013/0175016 | A1* | 7/2013 | Steele | F28F 1/00 165/175 |
| 2015/0059401 | A1 | 3/2015 | Matsuda et al. | |
| 2015/0101363 | A1 | 4/2015 | Matsuda et al. | |
| 2016/0047580 | A1 | 2/2016 | Cho et al. | |
| 2016/0169586 | A1 | 6/2016 | Ito et al. | |
| 2017/0328637 | A1* | 11/2017 | Parola | F28D 1/0443 |
| 2018/0120001 | A1* | 5/2018 | Byers | F28D 1/05391 |
| 2018/0172364 | A1* | 6/2018 | Liu | F28D 15/0275 |
| 2018/0274820 | A1 | 9/2018 | Maeyama | |
| 2018/0299203 | A1 | 10/2018 | Higashiue et al. | |
| 2018/0306515 | A1 | 10/2018 | Tada et al. | |
| 2019/0078817 | A1* | 3/2019 | Nakamura | F28D 1/053 |

FOREIGN PATENT DOCUMENTS

| | | | |
|---|---|---|---|
| CN | 103998891 | A | 8/2014 |
| CN | 104272040 | A | 1/2015 |
| CN | 104334997 | A | 2/2015 |
| CN | 105371539 | A | 3/2016 |
| CN | 105473973 | A | 4/2016 |
| CN | 106288893 | A | 1/2017 |
| CN | 106839829 | A | 6/2017 |
| CN | 107328144 | A | 11/2017 |
| CN | 108266925 | A | 7/2018 |
| CN | 109073290 | A | 12/2018 |
| GB | 8829086 | | 1/1989 |
| GB | 2226393 | A | 6/1990 |
| JP | 2005-016865 | A | 1/2005 |
| JP | 2011-214827 | A | 10/2011 |
| JP | 2012-042128 | A | 3/2012 |
| JP | 2015-055413 | A | 3/2015 |
| JP | 2015-200497 | A | 11/2015 |
| JP | 2018-112378 | A | 7/2018 |
| JP | 2018-112379 | A | 7/2018 |
| WO | 2008/064247 | A1 | 5/2008 |
| WO | WO 2013/160954 | A1 | 10/2013 |

OTHER PUBLICATIONS

Jul. 10, 2024, Chinese Office Action issued for related CN Application No. 202080091988.0.

Guo et al., Numerical simulation of two phase flow in manifold with perforated plate, A Engineering Technology Part II Power Engineering, Mar. 2014, pp. 40-45.

Dec. 16, 2024, European Office Action issued for related EP Application No. 20914898.0.

* cited by examiner

HEAT EXCHANGER

CROSS REFERENCE TO PRIOR APPLICATION

This application is a National Stage Patent Application of PCT International Patent Application No. PCT/JP2020/037356 (filed on Sep. 30, 2020) under 35 U.S.C. § 371, which claims priority to Japanese Patent Application No. 2020-008594 (filed on Jan. 22, 2020), which are all hereby incorporated by reference in their entirety.

FIELD

The present invention relates to a heat exchanger.

BACKGROUND

A heat exchanger is provided in a compressor unit and an indoor equipment of an air conditioner. The heat exchanger functions as an evaporator or a condenser by heat exchange between a coolant that flows inside a heat exchanger tube and the air that flows around fins that are arranged around the heat exchanger tube.

Heat exchangers include one in which heat exchanger tubes are multilayered at intervals vertically at the time of setting and one in which a plurality of rows of the multilayered heat exchanger tubes are aligned and coolant is caused to reciprocate through the rows (for example, Patent Literature 1). Specifically, the heat exchanger includes a plurality of first heat exchanger tubes with one ends connected to one header (inlet header) and a plurality of second heat exchanger tubes with one ends connected to another header (outlet header). Furthermore, the heat exchanger includes a return header to which other ends of the first heat exchanger tubes and other ends of the second heat exchanger tubes are connected. The return header includes a condenser space that connects the inside of the first heat exchanger tube and the inside of the second heat exchanger tube that are connected in the same position in the vertical direction. In other words, flow paths that are independent at each level are formed in the return header. The coolant that flows into the inlet header is divided into each of the first heat exchanger tubes in the inlet header. The coolant that flows through the first heat exchanger tubes flows into the second heat exchanger tubes at the same level as that of the first heat exchanger tubes. The coolant that flows through the second heat exchanger tubes joins in the outlet header and flows out of the outlet header. As described above, reciprocating the coolant makes the coolant flow path length long, which enables a lot of coolant to sufficiently evaporate.

When the heat exchanger is used as an evaporator, the state of the coolant that flows into the inlet header is preferably a gas-liquid two-phase state. In the above-described heat exchanger, when the coolant is divided into each of the first heat exchanger tubes in the inlet header, the coolant in the liquid-phase state goes down because of the effect of the gravity and the coolant in the gas state goes up. As a result, there is a problem in that an imbalance occurs in the distribution of the coolant in the inlet header and the coolant in the liquid-phase state and the coolant in the gas state tend not to be divided in the even state. The proportion of the gas phase of the coolant flowing through the heat exchanger tube on an upper side among the layered heat exchanger tubes is higher than the proportion of the gas phase of the coolant flowing through the heat exchanger tube on a lower side. In a coolant with a high proportion of the gas phase (high dryness), the amount of coolant that can be vaporized is small and therefore the amount of latent heat that contributes to heat exchange with a fluid outside the tube (the air) is small. In other words, the amount of heat exchange with the air differs between the heat exchanger tube on the upper side and the heat exchanger tube on the lower side among the layered heat exchanger tubes. As a result, the coolant flowing through the heat exchanger tube on the upper side enters an excessively-heated state before the coolant flowing through the heat exchanger tube on the lower side evaporates completely and an area that does not contribute to heat exchange with the air is caused in the heat exchanger. When a heat exchange area not contributing to heat exchange with the air occurs, the heat exchanger causes a decrease in ability of heat exchange. Thus, the heat exchanger illustrated in FIG. 10 in Patent Literature 2 forms a plurality of spaces that are aligned vertically in the inlet header to cause the coolant to flow into each of the spaces. The vertical length of each of the spaces is smaller than the vertical length of the entire header and therefore the effect of the gravity is reduced and it is possible to cause the coolant to be distributed in an even state and flow into a plurality of flat tubes that are connected to the respective spaces.

CITATION LIST

Patent Literature

Patent Literature 1: Japanese Laid-open Patent Publication No. 2011-214827

Patent Literature 2: Japanese Laid-open Patent Publication No. 2015-200497

SUMMARY

Technical Problem

In each of the spaces, however, unevenness in the coolant state in the vertical direction because of the effect of the gravity occurs. In the return header, the flow path independent at each level is formed inside and therefore improvement is not made until the unevenness in the coolant state occurring in the inlet header reaches the outlet header.

The disclosed technique was made in view of the above-described aspect and an object of the technique is to provide a heat exchanger capable of inhibiting occurrence of an area that does not contribute to heat exchange with the air even when a coolant is distributed in an uneven state to a plurality of heat exchanger tubes in an inlet header.

Solution to Problem

According to an aspect of an embodiment, a heat exchanger includes an inlet header in which a plurality of inlet spaces including a first inlet space and a second inlet space adjacent to and under the first inlet space are formed, a plurality of inlet-side heat exchanger tubes that includes a plurality of first inlet-side heat exchanger tubes that are connected to the first inlet space and that are aligned vertically and a plurality of second inlet-side heat exchanger tubes that are connected to the second inlet space and that are aligned vertically, a return header in which a plurality of return spaces that are connected to the inlet-side heat exchanger tubes, respectively, are formed, the return spaces including a plurality of first return spaces that are connected to the first inlet-side heat exchanger tubes, respectively, and that are aligned vertically and a plurality of second return spaces that are connected to the second inlet-side heat exchanger tubes, respectively, and that are aligned vertically, and a plurality of outlet-side heat exchanger tubes that are connected to the return spaces, respectively, and that are aligned vertically, wherein a communication path that enables a first return space on a bottom side among the first return spaces and a second return space on a top side among the second return spaces to communicate is further formed in the return header.

Advantageous Effects of Invention

A heat exchanger disclosed by the present application is capable of inhibiting occurrence of an area that does not contribute to heat exchange with the air even when a coolant is distributed in an uneven state to a plurality of heat exchanger tubes in an inlet header.

DESCRIPTION OF EMBODIMENTS

With reference to the drawings, a heat exchanger according to embodiments disclosed by the present application will be described below. Note that the following description does not limit the disclosed technique. In the following description, the same components are denoted with the same reference numbers and redundant description will be omitted.

First Embodiment

Figure 1:
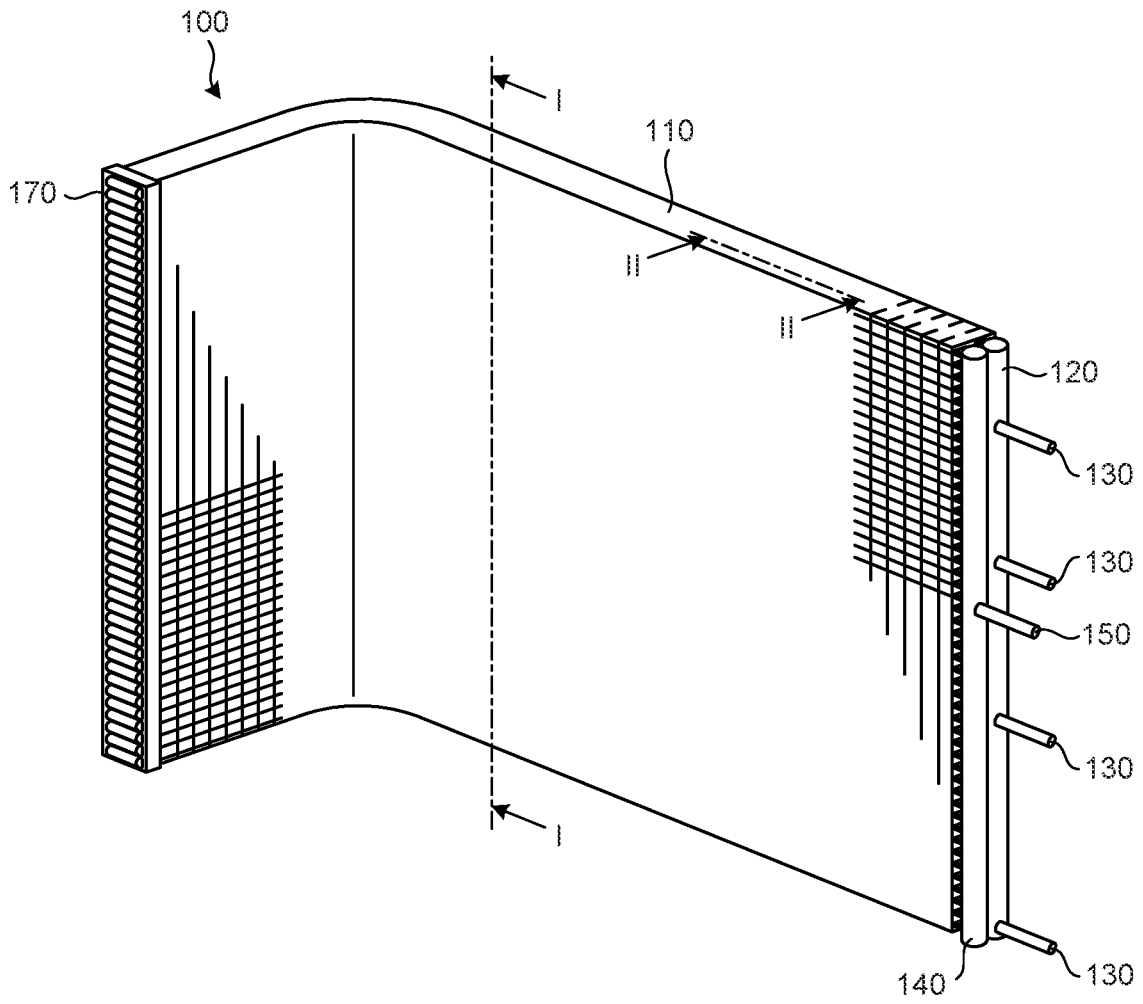
FIG. 1 is a perspective view illustrating a configuration of a heat exchanger of a first embodiment.

FIG. 1 is a perspective view illustrating a configuration of a heat exchanger 100 of a first embodiment. The heat exchanger 100 illustrated in FIG. 1 is provided in, for example, a compressor of an air conditioner and operates as an evaporator or a condenser. The heat exchanger 100 includes a heat exchange core 110, an inlet header 120, a flow-in tube 130, an outlet header 140, a flow-out tube 150 and a return header 170.

Figure 2:
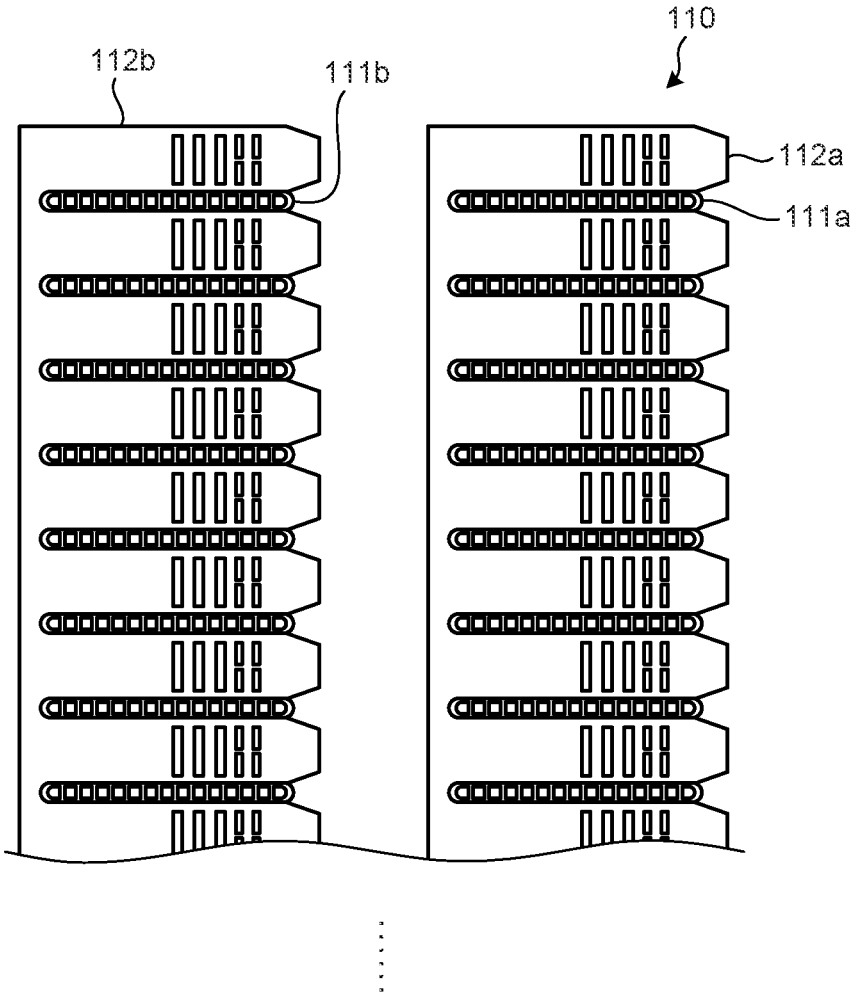
FIG. 2 is a diagram illustrating a cross-section taken along the line I-I in FIG. 1.
Figure 3:
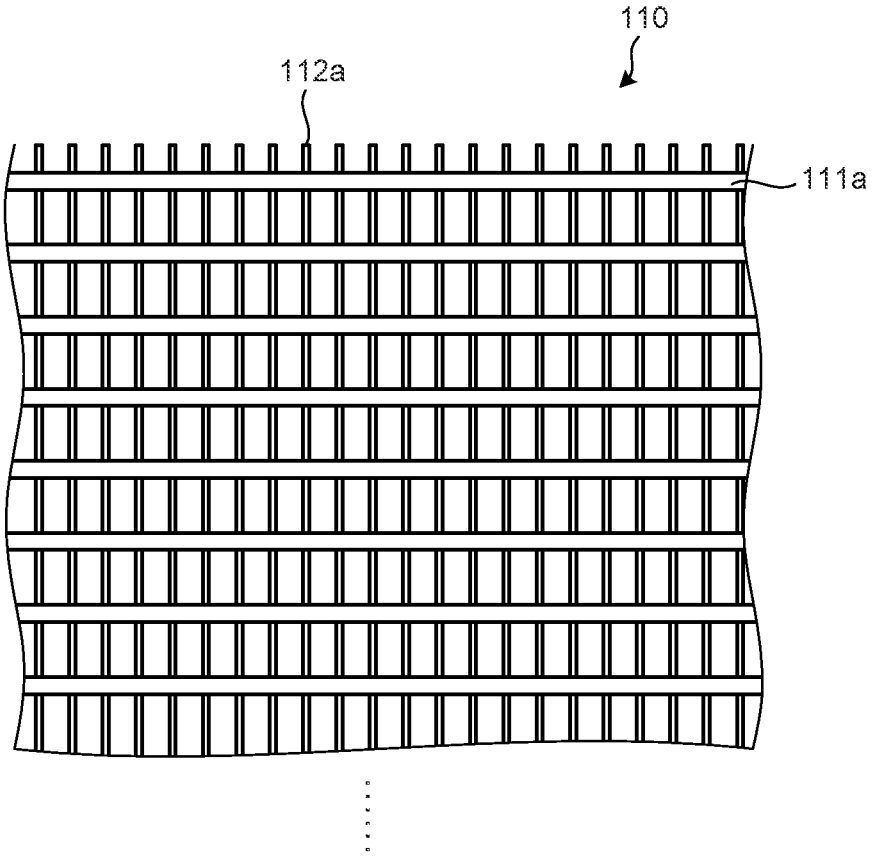
FIG. 3 is a diagram illustrating a cross-section taken along the line II-II in FIG. 1.

The heat exchange core 110 has a L-shape in a planar view and has two rows of heat exchanger tubes that are multilayered. The heat exchange core 110 includes a plurality of fins that guide the air around the heat exchanger tubes and promote heat exchange with a coolant that flows through the heat exchanger tubes. Specifically, FIG. 2 is a diagram illustrating a cross-section taken along the line I-I in FIG. 1 and FIG. 3 is a diagram illustrating a cross-section taken along the line II-II in FIG. 1. Note that, in FIG. 1, detailed illustration of the heat exchanger tubes and the fins that the heat exchange core 110 includes is omitted.

As illustrated in FIG. 2, the heat exchange core 110 includes an inlet-side heat exchanger tube 111*a*, an inlet-side fin 112*a*, an outlet-side heat exchanger tube 111*b* and an outlet-side fin 112*b*. The heat exchange core 110 includes a row in which the inlet-side heat exchanger tubes 111*a* are multilayered at intervals and a row in which the outlet-side heat exchanger tubes 111*b* are multilayered at intervals and the inlet-side heat exchanger tube 111*a* and the outlet-side heat exchanger tube 111*b* at the same level of each of the rows are arranged alignedly such that the inlet-side heat exchanger tube 111*a* and the outlet-side heat exchanger tube 111*b* stretches in parallel in proximity to each other. The inlet-side heat exchanger tube 111*a* and the outlet-side heat exchanger tube 111*b* are flat tubes whose cross-sections are flat and the inlet-side heat exchanger tube 111*a* and the outlet-side heat exchanger tube 111*b* have the same cross-sectional shape. On the cross-sections of the inlet-side heat exchanger tube 111*a* and the outlet-side heat exchanger tube 111*b*, a plurality of flow paths for the coolant are aligned in a longitudinal direction. The inlet-side heat exchanger tube 111*a* extends from the inlet header 120 to the return header 170 and the outlet-side heat exchanger tube 111*b* stretches from the outlet header 140 to the return header 170.

The inlet-side heat exchanger tubes 111*a* and the outlet-side heat exchanger tubes 111*b* penetrate through the inlet-side fins 112*a* and the outlet-side fins 112*b* that are in comb-like shapes and that stretch in the direction in which the inlet-side heat exchanger tubes 111*a* and the outlet-side heat exchanger tubes 111*b* are layered. In other words, for example, as illustrated in FIG. 3, the inlet-side heat exchanger tubes 111*a* penetrate through the inlet-side fins 112*a* and the coolant flowing through the inlet-side heat exchanger tubes 111*a* efficiently performs heat exchange with the air passing through between the inlet-side fins 112*a*. Similarly, the outlet-side heat exchanger tubes 111*b* penetrate through the outlet-side fins 112*b* and the coolant flowing through the outlet-side heat exchanger tubes 111*b* efficiently performs heat exchange with the air passing through between the outlet-side fins 112*b*.

The inlet-side fins 112*a* and the outlet-side fins 112*b* stretch in the direction in which the inlet-side heat exchanger tubes 111*a* and the outlet-side heat exchanger tubes 111*b* are layered and the inlet-side heat exchanger tubes 111*a* and the outlet-side heat exchanger tubes 111*b* are inserted between teeth of the comb-like shapes. In other words, the inlet-side heat exchanger tubes 111*a* that are arranged in a row in the direction of layering are inserted between the inlet-side fins 112*a* and the outlet-side heat exchanger tubes 111*b* that are arranged in a row in the direction of layering are inserted between the outlet-side fins 112*b*. The inlet-side fins 112*a* that are adjacent to each other in the direction in which the inlet-side heat exchanger tube 111*a* stretches have an interval in between and the spaces that are sectioned by the layered inlet-side heat exchanger tubes 111*a* and the adjacent inlet-side fins 112*a* serve as a passage for the air. Heat exchange is performed between the air passing through the passage and the coolant flowing through the inlet-side heat exchanger tube 111*a*. Similarly, the outlet-side fins 112*b* that are adjacent to each other in the direction in which the outlet-side heat exchanger tube 111*b* stretches have an interval in between and the spaces that are sectioned by the layered outlet-side heat exchanger tubes 111*b* and the adjacent outlet-side fins 112*b* serve as a passage for the air. Heat exchange is performed between the air passing through the passage and the coolant flowing through the outlet-side heat exchanger tube 111*b*.

The inlet header 120 and the outlet header 140 are provided at an end of the heat exchanger 100. The inlet header 120 is connected to the inlet-side heat exchanger tubes 111*a* that are arranged in a row in the direction of layering and the outlet header 140 is connected to the outlet-side heat exchanger tubes 111*b* that are arranged in a row in the direction of layering.

When the heat exchanger 100 functions as an evaporator, the inlet header 120 serves as an inlet header for the coolant and sends out, to the inlet-side heat exchanger tubes 111*a*, the coolant in a gas-liquid two-phase state that flows in from the flow-in tube 130. When the heat exchanger 100 functions as a condenser, the inlet header 120 serves as an outlet header for the coolant and sends out, to the flow-in tube 130, the coolant in the gas-liquid two-phase state that flows in from the inlet-side heat exchanger tubes 111*a*.

When the heat exchanger 100 functions as an evaporator, the outlet header 140 serves as an outlet header for the coolant and sends out, to the flow-out tube 150, the coolant in the gas-liquid two-phase state or in a gas single-phase state that flows in from the outlet-side heat exchanger tubes 111*b*. When the heat exchanger 100 functions as a condenser, the outlet header 140 serves as an inlet header for the coolant and sends out the coolant in the gas single-phase state that flows in from the flow-out tube 150 to the outlet-side heat exchanger tubes 111*b*.

The return header 170 is provided on an end part of the heat exchanger 100 that is opposite to the one end at which the inlet header 120 and the outlet header 140 are provided and the return header 170 connects the inlet-side heat exchanger tubes 111*a* and the outlet-side heat exchanger tubes 111*b*. In other words, the return header 170 has a space to which the tips of the inlet-side heat exchanger tube 111*a* and the outlet-side heat exchanger tube 111*b* in a pair at the same level are connected commonly, causes the coolant that flows out of the tip of the inlet-side heat exchanger tube 111*a* to return to and flow into the outlet-side heat exchanger tube 111*b*, and causes the coolant that flows out of the tip of the outlet-side heat exchanger tube 111*b* to return to and flow into the inlet-side heat exchanger tube 111*a*.

Figure 4:
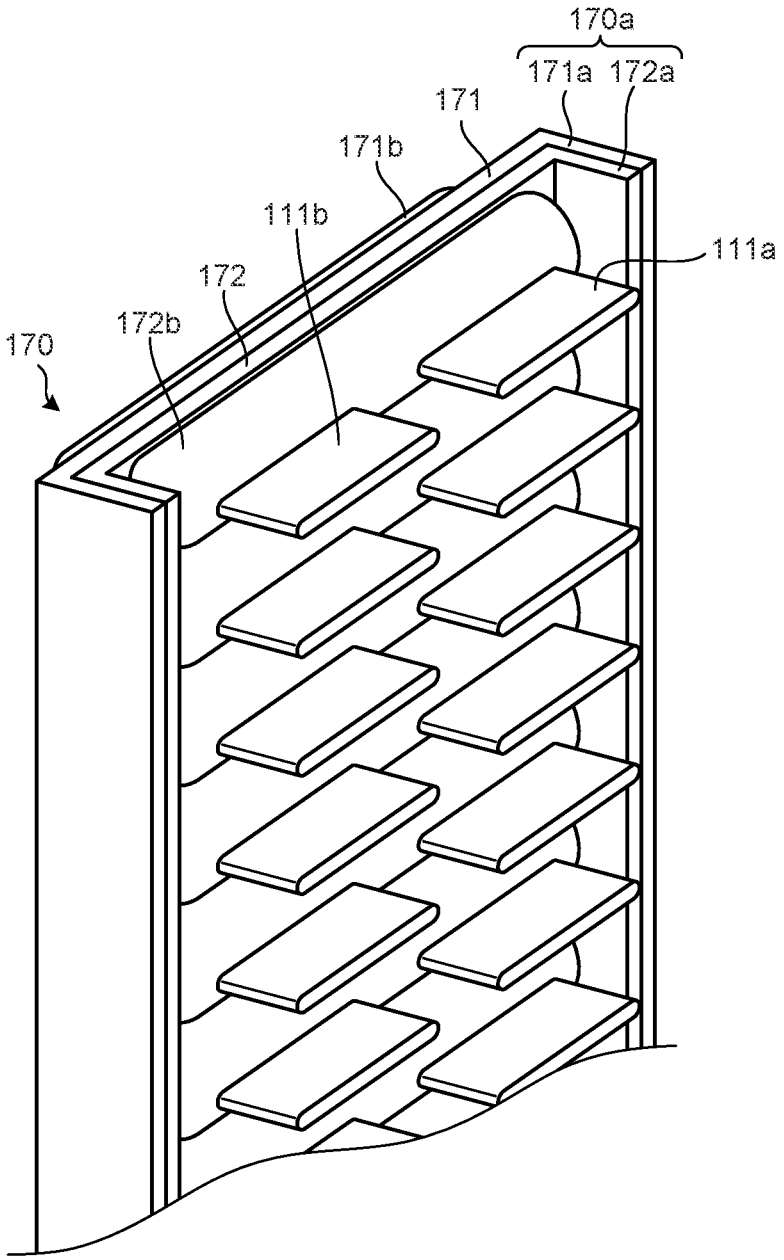
FIG. 4 is a diagram illustrating a configuration of a return header.

FIG. 4 is a diagram illustrating a configuration of the return header 170. FIG. 4 is a perspective view of the return header 170 viewed from the side of the inlet-side heat exchanger tube 111*a* and the outlet-side heat exchanger tube 111*b* (in other words, the inside of the heat exchanger 100).

The return header 170 is formed by joining two platy members 171 and 172 by, for example, brazing. An end portion 171*a* of the platy member 171 in a row-width direction in which the inlet-side heat exchanger tube 111*a* and the outlet-side heat exchanger tube 111*b* in a pair at the same level are arranged (simply referred to as "row-width" direction below) is bent to the sides of the inlet-side heat exchanger tubes 111*a* and the outlet-side heat exchanger tubes 111*b* and an end portion 172*a* of the platy member 172 in the row-width direction is bent to the sides of the inlet-side heat exchanger tubes 111*a* and the outlet-side heat exchanger tubes 111*b*. The join between the end portion 171*a* of the platy member 171 and the end portion 172*a* of the platy member 172 forms a bent portion 170*a* of the return header 170. In other words, both ends of the join between the two platy members 171 and 172 in the row-width direction serve as the bent portion 170*a* that is bent to the side of the platy member 172.

A concave portion 171*b* at each level of the inlet-side heat exchanger tube 111*a* and the outlet-side heat exchanger tube 111*b* is formed at the center of the platy member 171 and a concave portion 172*b* at each level of the inlet-side heat exchanger tube 111*a* and the outlet-side heat exchanger tube 111*b* is formed at the center of the platy member 172. The platy members 171 and 172 are joined such that the concave portions 171*b* and 172*b* corresponding to the same level of the inlet-side heat exchanger tube 111*a* and the outlet-side heat exchanger tube 111*b* are opposed to each other and a space is formed by the concave portions 171*b* and 172*b* that are opposed to each other. An alloy material that joins the platy members 171 and 172 is contained in, for example, a cladding layer that is formed on a surface of the platy member 172 and the cladding layer is heated and accordingly the alloy material fuses and joins the platy member 171 and the platy member 172. The tips of the inlet-side heat exchanger tube 111*a* and the outlet-side heat exchanger tube 111*b* penetrate a bottom portion of the concave portion 172*b* and the space that is formed by the concave portions 171*b* and 172*b* connects the inlet-side heat exchanger tube 111*a* and the outlet-side heat exchanger tube 111*b*. In other words, the coolant can return between the inlet-side heat exchanger tube 111*a* and the outlet-side heat exchanger tube 111*b* via the space that is formed by the concave portions 171*b* and 172*b*.

The part of the platy members 171 and 172 excluding the concave portions 171*b* and 172*b* serve as the join that is joined by brazing to the platy members 172 and 171. In other words, the part of the platy member 171 excluding the concave portion 171*b* serves as the join that is joined by, for example, brazing to the platy member 172 and the part of the platy member 172 excluding the concave portion 172*b* serves as the join that is joined by, for example, brazing to the platy member 171. In order to ensure strength of joining between the platy members 171 and 172, the join of each of the platy members 171 and 172 has an area equal to or larger than a certain area. In other words, the return header 170 illustrated in, for example, FIG. 4 has the join having relatively large areas on a lateral side of the concave portions 171*b* and 172*b*.

As illustrated above, the end portions 171*a* and 172*a* of the joins in the row-width direction serve as the bent portion 170*a* of the return header 170. The bent portion 170*a* is bent approximately in parallel with the direction in which the inlet-side heat exchanger tube 111*a* and the outlet-side heat exchanger tube 111*b* penetrating the bottom portion of the concave portion 172*b* stretch. In other words, the bent portion 170*a* is bent approximately perpendicularly to the join around the concave portions 171*b* and 172*b*.

The bent portion 170*a* is formed as described above and thus, even when the strength of joining is ensured by increasing the area of the join of the platy members 171 and 172, it is possible to reduce the size of the return header 170 in the row-width direction. As a result, the space occupied by the return header 170 is reduced, which enables space saving.

Figure 5:
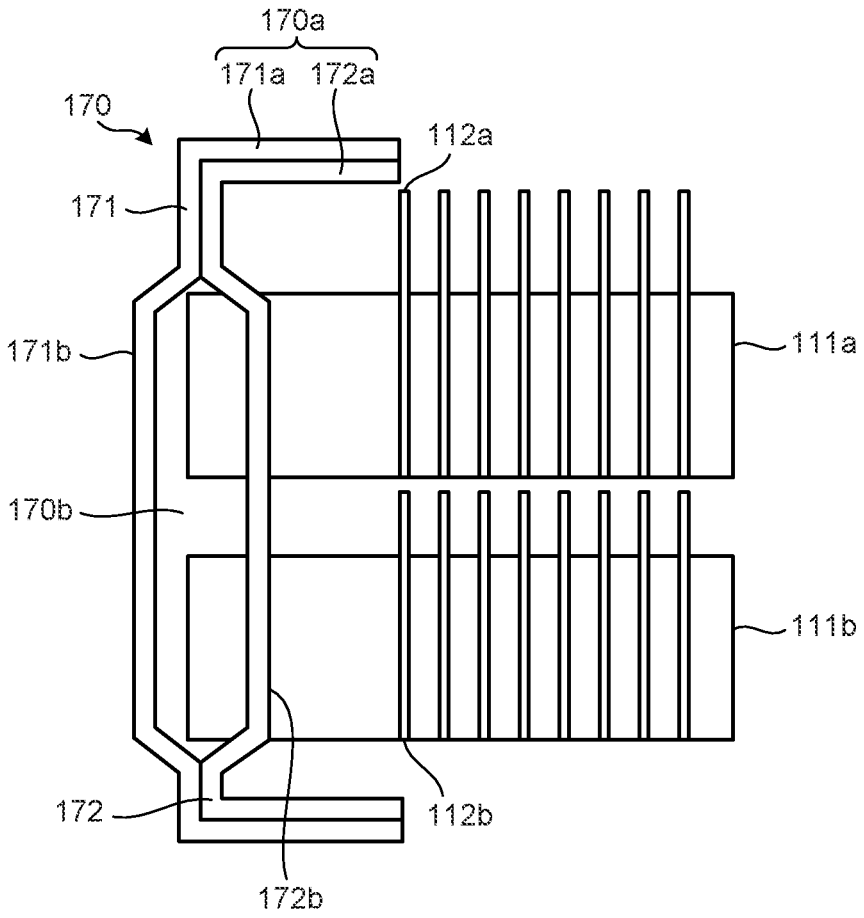
FIG. 5 is a diagram illustrating a shape of the return header.

FIG. 5 is a diagram illustrating a cross section of the return header 170 in a plane perpendicular to the direction in which the inlet-side heat exchanger tubes 111*a* and the outlet-side heat exchanger tubes 111*b* are layered (simply referred to as "direction of layering" below).

As illustrated in FIG. 5, the platy members 171 and 172 are joined such that the bottom portions of the concave portion 171*b* of the platy member 171 and the concave portion 172*b* of the platy member 172 are opposed to each other and accordingly a space 170*b* that connects the inlet-side heat exchanger tube 111*a* and the outlet-side heat exchanger tube 111*b* is formed. The tips of the inlet-side heat exchanger tube 111*a* and the outlet-side heat exchanger tube 111*b* penetrate the bottom portion of the concave portion 172*b* and reach the space 170*b*. Accordingly, the inlet-side heat exchanger tube 111*a* and the outlet-side heat exchanger tube 111*b* are connected via the space 170*b*.

The part excluding the concave portions 171*b* and 172*b* serve as the join that joins the platy members 171 and 172 by brazing and both ends of the join in the row-width direction serve as the bent portion 170*a* that is bent in the direction approximately in parallel with the direction in which the inlet-side heat exchanger tube 111*a* and the outlet-side heat exchanger tube 111*b* stretch. In other words, the end portion 171*a* of the platy member 171 in the row-width direction is bent to the sides of the inlet-side heat exchanger tubes 111*a* and the outlet-side heat exchanger tubes 111*b* and the end portion 172*a* of the platy member 172 in the row-width direction is bent to the sides of the inlet-side heat exchanger tubes 111*a* and the outlet-side heat exchanger tubes 111*b* and the end portions 171*a* and 172*a* are joined, so that the bent portion 170*a* is formed.

Figure 6:
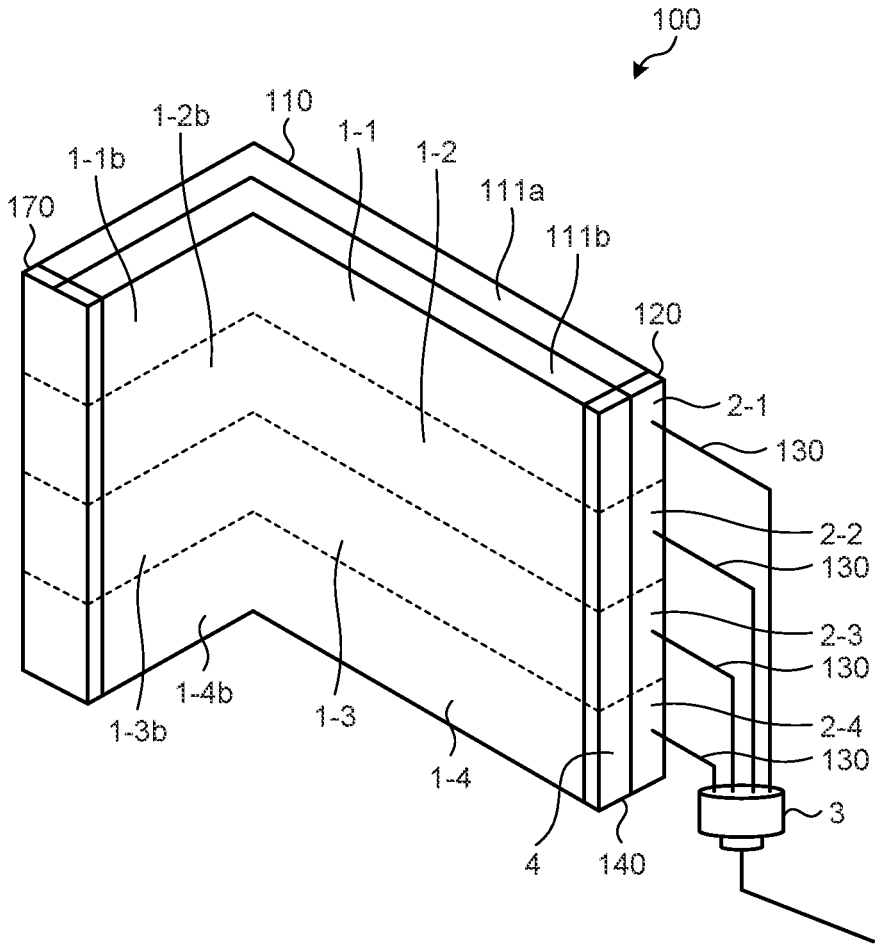
FIG. 6 is a schematic diagram illustrating a heat exchanger.
Figure 7:
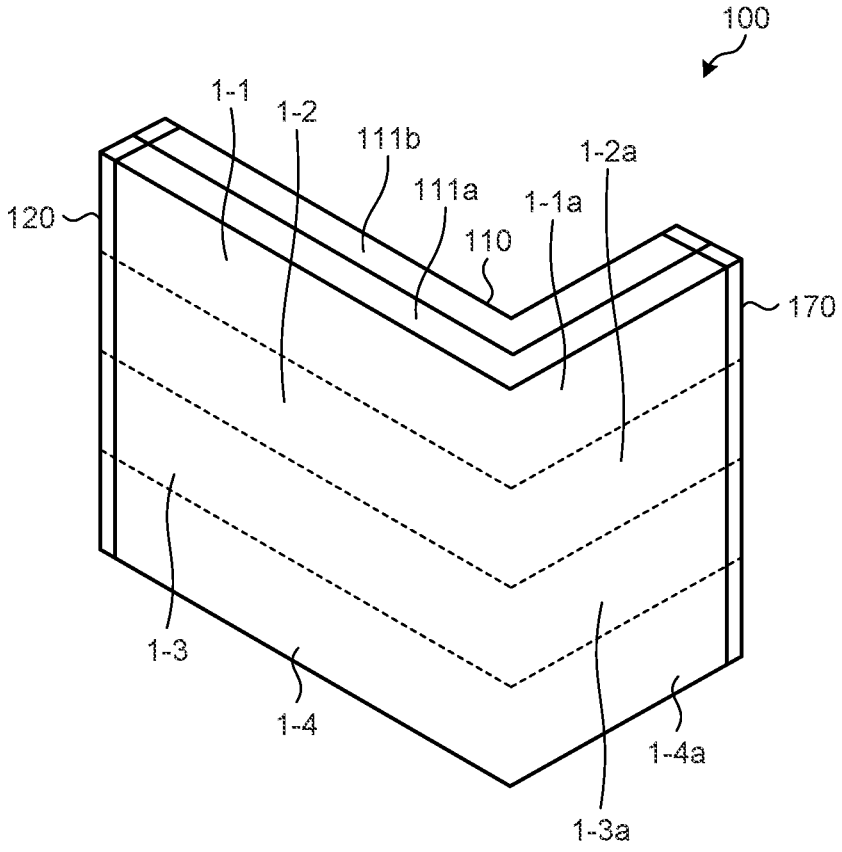
FIG. 7 is another schematic diagram illustrating the heat exchanger.

FIG. 6 is a schematic diagram illustrating the heat exchanger 100. FIG. 7 is another schematic diagram illustrating the heat exchanger 100. The heat exchange core 110 includes a first heat exchanger unit 1-1, a second heat exchanger unit 1-2, a third heat exchanger unit 1-3 and a fourth heat exchanger unit 1-4. The first heat exchanger unit 1-1, the second heat exchanger unit 1-2, the third heat exchanger unit 1-3 and the fourth heat exchanger unit 1-4 are aligned vertically when the heat exchanger 100 is set appropriately. The first heat exchanger unit 1-1 includes a plurality of first inlet-side heat exchanger tubes 1-1*a* and a plurality of first outlet-side heat exchanger tubes 1-1*b*. The first inlet-side heat exchanger tubes 1-1*a* are contained in the inlet-side heat exchanger tubes 111*a* and are aligned vertically. The first outlet-side heat exchanger tubes 1-1*b* are contained in the outlet-side heat exchanger tubes 111*b* and are aligned vertically.

The second heat exchanger unit 1-2 is arranged under and adjacent to the first heat exchanger unit 1-1 and includes a plurality of second inlet-side heat exchanger tubes 1-2*a* and a plurality of second outlet-side heat exchanger tubes 1-2*b*. The second inlet-side heat exchanger tubes 1-2*a* are contained in the inlet-side heat exchanger tubes 111*a* and are aligned vertically. The second outlet-side heat exchanger tubes 1-2*b* are contained in the outlet-side heat exchanger tubes 111*b* and are aligned vertically. The second inlet-side heat exchanger tube on a top side among the second inlet-side heat exchanger tubes 1-2*a* is arranged under and adjacently to the first inlet-side heat exchanger tube on a bottom side among the first inlet-side heat exchanger tubes 1-1*a*. The second outlet-side heat exchanger tube on a top side among the second outlet-side heat exchanger tubes 1-2*b* is arranged under and adjacently to the first outlet-side heat exchanger tube on a bottom side among the first outlet-side heat exchanger tubes 1-1*b*. The second heat exchanger unit 1-2 contains the second inlet-side heat exchanger tubes 1-2*a* and the second outlet-side heat exchanger tubes 1-2*b*.

The third heat exchanger unit 1-3 is arranged under and adjacent to the second heat exchanger unit 1-2 and includes a plurality of third inlet-side heat exchanger tubes 1-3*a* and a plurality of third outlet-side heat exchanger tubes 1-3*b*. The third inlet-side heat exchanger tubes 1-3*a* are contained in the inlet-side heat exchanger tubes 111*a* and are aligned vertically. The third outlet-side heat exchanger tubes 1-3*b* are contained in the outlet-side heat exchanger tubes 111*b* and are aligned vertically. The third inlet-side heat exchanger tube on a top side among the third inlet-side heat exchanger tubes 1-3*a* is arranged under and adjacently to the second inlet-side heat exchanger tube on a bottom side among the second inlet-side heat exchanger tubes 1-2*a*. The third outlet-side heat exchanger tube on a top side among the third outlet-side heat exchanger tubes 1-3*b* is arranged under and adjacently to the second outlet-side heat exchanger tube on a bottom side among the second outlet-side heat exchanger tubes 1-2*b*. The third heat exchanger unit 1-3 contains the third inlet-side heat exchanger tubes 1-3*a* and the third outlet-side heat exchanger tubes 1-3*b*.

The fourth heat exchanger unit 1-4 is arranged under and adjacent to the third heat exchanger unit 1-3 and includes a plurality of fourth inlet-side heat exchanger tubes 1-4*a* and a plurality of fourth outlet-side heat exchanger tubes 1-4*b*. The fourth inlet-side heat exchanger tubes 1-4*a* are contained in the inlet-side heat exchanger tubes 111*a* and are aligned vertically. The fourth outlet-side heat exchanger tubes 1-4*b* are contained in the outlet-side heat exchanger tubes 111*b* and are aligned vertically. The fourth inlet-side heat exchanger tube on a top side among the fourth inlet-side heat exchanger tubes 1-4*a* is arranged under and adjacently to the second third inlet-side heat exchanger tube on a bottom side among the third inlet-side heat exchanger tubes 1-3*a*. The fourth outlet-side heat exchanger tube on a top side among the fourth outlet-side heat exchanger tubes 1-4*b* is arranged under and adjacently to the third outlet-side heat exchanger tube on a bottom side among the third outlet-side heat exchanger tubes 1-3*b*. The fourth heat exchanger unit 1-4 contains the fourth inlet-side heat exchanger tubes 1-4*a* and the fourth outlet-side heat exchanger tubes 1-4*b*.

In the inlet header 120, a first inlet space 2-1, a second inlet space 2-2, a third inlet-space 2-3 and a fourth inlet-space 2-4 are formed. The first inlet space 2-1, the second inlet space 2-2, the third inlet-space 2-3 and the fourth inlet-space 2-4 are isolated from one another. The first inlet-side heat exchanger tubes 1-1*a* of the first heat exchanger unit 1-1 are connected to the first inlet space 2-1. At that time, one ends of the first inlet-side heat exchanger tubes 1-1*a* that are connected to the first inlet space 2-1 are arranged alignedly and vertically.

The second inlet space 2-2 is arranged under the first inlet space 2-1. The second inlet-side heat exchanger tubes 1-2*a* of the second heat exchanger unit 1-2 are connected to the second inlet space 2-2. At that time, one ends of the second inlet-side heat exchanger tubes 1-2*a* that are connected to the second inlet space 2-2 are arranged alignedly and vertically.

The third inlet space 2-3 is arranged under the second inlet space 2-2. The third inlet-side heat exchanger tubes 1-3*a* of the third heat exchanger unit 1-3 are connected to the third inlet space 2-3. At that time, one ends of the third inlet-side heat exchanger tubes 1-3*a* that are connected to the third inlet space 2-3 are arranged alignedly and vertically.

The fourth inlet space 2-4 is arranged under the third inlet space 2-3. The fourth inlet-side heat exchanger tubes 1-4*a* of the fourth heat exchanger unit 1-4 are connected to the fourth inlet space 2-4. At that time, one ends of the fourth inlet-side heat exchanger tubes 1-4*a* that are connected to the fourth inlet space 2-4 are arranged alignedly and vertically.

The heat exchanger 100 further includes a flow divider 3. The flow divider 3 is connected to the first inlet space 2-1, the second inlet space 2-2, the third inlet-space 2-3 and the fourth inlet-space 2-4 of the inlet header 120 via a plurality of the flow-in tubes 130. The flow divider 3 divides the gas-liquid two-phase coolant such that the degrees of dryness of the gas-liquid two-phase coolant supplied to the first inlet space 2-1, the second inlet space 2-2, the third inlet-space 2-3 and the fourth inlet-space 2-4 are approximately equal and supplies the gas-liquid two-phase coolant to the inlet header 120.

An outlet space 4 is formed in the outlet header 140. The first outlet-side heat exchanger tubes 1-1*b*, the second outlet-side heat exchanger tubes 1-2*b*, the third outlet-side heat exchanger tubes 1-3*b* and the fourth outlet-side heat exchanger tubes 1-4*b* are connected to the outlet space 4. In other words, one ends of the outlet-side heat exchanger tubes 111*b* are arranged in the outlet space 4. The return header 170 is connected to the other ends of the first heat exchanger unit 1-1, the second heat exchanger unit 1-2, the third heat exchanger unit 1-3 and the fourth heat exchanger unit 1-4 on a side opposite to one ends that are connected to the inlet header 120 and the outlet header 140.

Figure 8:
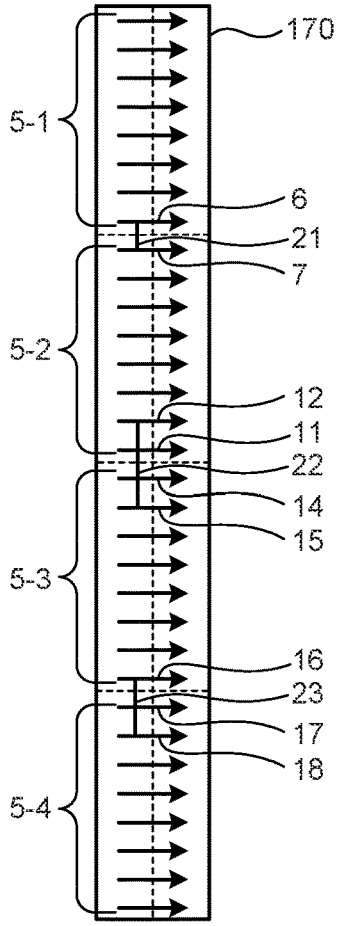
FIG. 8 is a schematic diagram illustrating the return header.

FIG. 8 is a schematic diagram illustrating the return header 170. In the return header 170, a plurality of return spaces represented by the right-pointing arrows in FIG. 8 are formed. Each of the return spaces are formed like the space 170*b* and the return spaces are isolated from one another. The total number of the return spaces is equal to the total number of the inlet-side heat exchanger tubes 111*a* and is equal to the total number of the outlet-side heat exchanger tubes 111*b*. The return spaces contain a plurality of first return spaces 5-1, a plurality of second return spaces 5-2, a plurality of third return spaces 5-3 and a plurality of fourth return spaces 5-4. The first return spaces 5-1 are connected to the first inlet-side heat exchanger tubes 1-1*a*, respectively, and are connected to the first outlet-side heat exchanger tubes 1-1*b*, respectively. In other words, each of the first return spaces 5-1 is connected to one first inlet-side heat exchanger tube among the first inlet-side heat exchanger tubes 1-1*a* and is connected to one first outlet-side heat exchanger tube among the first outlet-side heat exchanger tubes 1-1*b*.

The first return spaces 5-1 contain a first return space 6 that is the lowest (on a bottom side). The lowest first return space 6 is connected to the lowest first inlet-side heat exchanger tube among the first inlet-side heat exchanger tubes 1-1*a*. The lowest first inlet-side heat exchanger tube is a flow path that is arranged on the bottom side among the first inlet-side heat exchanger tubes 1-1*a* and one end of the lowest first inlet-side heat exchanger tube on a side connected to the first inlet space 2-1 is connected to the portion of the first inlet space 2-1 on the bottom side. In other words, one end of another first inlet-side heat exchanger tube different from the lowest first inlet-side heat exchanger tube among the first inlet-side heat exchanger tubes 1-1*a* is arranged in a portion in the first inlet space 2-1 above the portion in which the one end of the lowest first inlet-side heat exchanger tube is arranged.

The second return spaces 5-2 are connected to the second inlet-side heat exchanger tubes 1-2*a*, respectively, and are connected to the second outlet-side heat exchanger tubes 1-2*b*, respectively. In other words, each of the second return spaces 5-2 is connected to one second inlet-side heat exchanger tube among the second inlet-side heat exchanger tubes 1-2*a* and is connected to one second outlet-side heat exchanger tube among the second outlet-side heat exchanger tubes 1-2*b*. The second return spaces 5-2 contain a second return space 7 that is the highest (on a top side). The highest second return space 7 is connected to the highest second inlet-side heat exchanger tube among the second inlet-side heat exchanger tubes 1-2*a*. The highest second inlet-side heat exchanger tube is a flow path that is arranged on the top side among the second inlet-side heat exchanger tubes 1-2*a* and one end of the highest second inlet-side heat exchanger tube on a side connected to the second inlet space 2-2 is connected to the portion of the second inlet space 2-2 on the top side. In other words, one end of another second inlet-side heat exchanger tube different from the highest second inlet-side heat exchanger tube among the second inlet-side heat exchanger tubes 1-2*a* is arranged in a portion in the second inlet space 2-2 under the portion in which the one end of the highest second inlet-side heat exchanger tube is arranged.

The second return spaces 5-2 further contains a second return space 11 that is the lowest and a second return space 12 that is the second lowest. The lowest second return space 11 is connected to the lowest second inlet-side heat exchanger tube among the second inlet-side heat exchanger tubes 1-2*a*. The lowest second inlet-side heat exchanger tube is a flow path that is arranged on the bottom side among the second inlet-side heat exchanger tubes 1-2*a* and one end of the lowest second inlet-side heat exchanger tube on a side connected to the second inlet space 2-2 is connected to the portion of the second inlet space 2-2 on the lowest side. The second lowest second return space 12 is connected to the second lowest second inlet-side heat exchanger tube among the second inlet-side heat exchanger tubes 1-2*a*. The second lowest second inlet-side heat exchanger tube is a flow path that is arranged on the lower side secondly among the second inlet-side heat exchanger tubes 1-2*a*. One end of the second lowest second inlet-side heat exchanger tube on a side connected to the second inlet space 2-2 is connected to the portion of the second inlet space 2-2 that is on the lower side secondly after the end of the lowest second inlet-side heat exchanger tube.

The third return spaces 5-3 are connected to the third inlet-side heat exchanger tubes 1-3*a*, respectively, and are connected to the third outlet-side heat exchanger tubes 1-3*b*, respectively. In other words, each of the third return spaces 5-3 is connected to one third inlet-side heat exchanger tube among the third inlet-side heat exchanger tubes 1-3*a* and is connected to one third outlet-side heat exchanger tube among the third outlet-side heat exchanger tubes 1-3*b*. The third return spaces 5-3 contain a third return space 14 that is the highest and a third return space 15 that is the second highest. The highest third return space 14 is connected to the highest third inlet-side heat exchanger tube among the third inlet-side heat exchanger tubes 1-3*a*. The highest third inlet-side heat exchanger tube is a flow path that is arranged on the top side among the third inlet-side heat exchanger tubes 1-3*a* and one end of the highest third inlet-side heat exchanger tube on a side connected to the third inlet space 2-3 is connected to the portion of the third inlet space 2-3 on the top side. In other words, one end of another third inlet-side heat exchanger tube different from the highest third inlet-side heat exchanger tube among the third inlet-side heat exchanger tubes 1-3*a* is arranged in a portion in the third inlet space 2-3 under the portion in which the one end of the highest third inlet-side heat exchanger tube is arranged. The second highest third return space 15 is connected to the second highest third inlet-side heat exchanger tube among the third inlet-side heat exchanger tubes 1-3*a*. The second highest third inlet-side heat exchanger tube is a flow path that is arranged on the higher side secondly after the highest third inlet-side heat exchanger tube among the third inlet-side heat exchanger tubes 1-3*a*. One end of the second highest third inlet-side heat exchanger tube on a side connected to the third inlet space 2-3 is connected to the portion that is on the upper side secondly after the end of the highest third inlet-side heat exchanger tube.

The third return spaces 5-3 further contain a third return space 16 that is the lowest. The lowest third return space 16 is connected to the lowest third inlet-side heat exchanger tube among the third inlet-side heat exchanger tubes 1-3*a*. The lowest third inlet-side heat exchanger tube is a flow path that is arranged on the bottom side among the third inlet-side heat exchanger tubes 1-3*a* and one end of the lowest third inlet-side heat exchanger tube on a side connected to the third inlet space 2-3 is connected to the portion of the third inlet space 2-3 on the lowest side. In other words, one end of another third inlet-side heat exchanger tube different from the lowest third inlet-side heat exchanger tube among the third inlet-side heat exchanger tubes 1-3*a* is arranged in a portion in the third inlet space 2-3 above the portion in which the one end of the lowest third inlet-side heat exchanger tube is arranged.

The fourth return spaces 5-4 are connected to the fourth inlet-side heat exchanger tubes 1-4*a*, respectively, and are connected to the fourth outlet-side heat exchanger tubes 1-4*b*, respectively. In other words, each of the fourth return spaces 5-4 is connected to one fourth inlet-side heat exchanger tube among the fourth inlet-side heat exchanger tubes 1-4*a* and is connected to one fourth outlet-side heat exchanger tube among the fourth outlet-side heat exchanger tubes 1-4*b*. The fourth return spaces 5-4 contain a fourth return space 17 that is the highest and a fourth return space 18 that is the second highest. The highest fourth return space 17 is connected to the highest fourth inlet-side heat exchanger tube among the fourth inlet-side heat exchanger tubes 1-4*a*. The highest fourth inlet-side heat exchanger tube is a flow path that is arranged on the top side among the fourth inlet-side heat exchanger tubes 1-4*a* and one end of the highest fourth inlet-side heat exchanger tube on a side connected to the fourth inlet space 2-4 is connected to the portion of the fourth inlet space 2-4 on the top side. In other words, one end of another fourth inlet-side heat exchanger tube different from the highest fourth inlet-side heat exchanger tube among the fourth inlet-side heat exchanger tubes 1-4*a* is arranged in a portion in the fourth inlet space 2-4 under the portion in which the one end of the highest fourth inlet-side heat exchanger tube is arranged. The second highest fourth return space 18 is connected to the second highest fourth inlet-side heat exchanger tube among the fourth inlet-side heat exchanger tubes 1-4*a*. The second highest fourth inlet-side heat exchanger tube is a flow path that is arranged on the higher side secondly after the highest fourth inlet-side heat exchanger tube among the fourth inlet-side heat exchanger tubes 1-4*a*. One end of the second highest fourth inlet-side heat exchanger tube on a side connected to the fourth inlet space 2-4 is connected to the portion that is on the upper side secondly after the end of the highest fourth inlet-side heat exchanger tube.

The return header 170 further includes a first coolant tube 21, a second coolant tube 22 and a third coolant tube 23. A first communication path is formed in the first coolant tube 21. The first communication path communicates with the lowest first return space 6 among the first return spaces 5-1 and communicates with the highest second return space 7 among the second return spaces 5-2. A second communication path is formed in the second coolant tube 22. The second communication path communicates with the lowest second return space 11 and the second lowest second return space 12 among the second return spaces 5-2 and communicates with the highest third return space 14 and the second highest third return space 15 among the third return spaces 5-3. A third communication path is formed in the third coolant tube 23. The third communication path communicates with the lowest third return space 16 among the third return spaces 5-3 and communicates with the highest fourth return space 17 and the second highest fourth return space 18 among the fourth return spaces 5-4.

Operations of Heat Exchanger 100 of First Embodiment

The heat exchanger 100 operates as an evaporator or a condenser. In operations serving as an evaporator, the flow divider 3 divides the coolant that flows in such that the degrees of dryness of the gas-liquid two-phase coolant supplied to the first inlet space 2-1, the second inlet space 2-2, the third inlet-space 2-3 and the fourth inlet-space 2-4 of the inlet header 120 are approximately equal.

Part of the liquid phase coolant of the gas-liquid two-phase coolant that is supplied to the first inlet space 2-1 goes down due to the gravity. For this reason, the dryness of the gas-liquid two-phase coolant in an area on an upper side in the first inlet space 2-1 is larger than the dryness of the gas-liquid two-phase coolant in an area on a lower side in the first inlet space 2-1. The gas-liquid two-phase coolant that is supplied to the first inlet space 2-1 is supplied to the first inlet-side heat exchanger tubes 1-1*a* and flows through the first inlet-side heat exchanger tubes 1-1*a*. At that time, the dryness of the gas-liquid two-phase coolant supplied to the first inlet-side heat exchanger tubes 1-1*a* is larger in the first inlet-side heat exchanger tube that is arranged on the upper side.

As for the gas-liquid two-phase coolant that is supplied to each of the second inlet space 2-2, the third inlet space 2-3 and the fourth inlet space 2-4, as in the gas-liquid two-phase coolant in the first inlet space 2-1, the dryness of the gas-liquid two-phase coolant on the upper side is larger than the dryness of the gas-liquid two-phase coolant on the lower side. The gas-liquid two-phase coolant that is supplied to each of the second inlet space 2-2, the third inlet space 2-3 and the fourth inlet space 2-4 is supplied to each of the second inlet-side heat exchanger tubes 1-2*a*, the third inlet-side heat exchanger tubes 1-3*a* and the fourth inlet-side heat exchanger tubes 1-4*a*. For this reason, the dryness of the gas-liquid two-phase coolant supplied to the second inlet-side heat exchanger tubes 1-2*a* is larger in the second inlet-side heat exchanger tube arranged on the upper side as in the gas-liquid two-phase coolant that is supplied to the first inlet-side heat exchanger tubes 1-1*a*. Similarly, the dryness of the gas-liquid two-phase coolant supplied to the third inlet-side heat exchanger tubes 1-3*a* is larger in the third inlet-side heat exchanger tube arranged on the upper side and the dryness of the gas-liquid two-phase coolant supplied to the fourth inlet-side heat exchanger tubes 1-4*a* is larger in the fourth inlet-side heat exchanger tube arranged on the upper side.

The air that flows outside the inlet-side heat exchanger tubes 111*a* and the gas-liquid two-phase coolant that flows through the inlet-side heat exchanger tubes 111*a* thermally make contact with the inlet-side heat exchanger tubes 111*a* and accordingly heat is exchanged mutually via the inlet-side heat exchanger tubes 111*a*. In other words, the air flowing outside the inlet-side heat exchanger tubes 111*a* is cooled by such heat exchange. As for the gas-liquid two-phase coolant flowing through the inlet-side heat exchanger tubes 111*a*, part of the liquid phase coolant of the gas-liquid two-phase coolant evaporates by such heat exchange and the dryness increases.

The gas-liquid two-phase coolant having flown through the inlet-side heat exchanger tubes 111*a* is supplied to the first return spaces 5-1, the second return spaces 5-2, the third return spaces 5-3 and the fourth return spaces 5-4 of the return header 170. Specifically, the gas-liquid two-phase coolant having flown through a first inlet-side heat exchanger tube among the first inlet-side heat exchanger tubes 1-1*a* is supplied to the first return space that is connected to the first inlet-side heat exchanger tube among the first return spaces 5-1. For example, the gas-liquid two-phase coolant having flown through the lowest first inlet-side heat exchanger tube among the first inlet-side heat exchanger tubes 1-1*a* is supplied to the first return space 6 that is the lowest among the first return spaces 5-1.

Like the gas-liquid two-phase coolant having flown through the second inlet-side heat exchanger tubes 1-2*a*, the gas-liquid two-phase coolant having flown through the second inlet-side heat exchanger tubes 1-2*a* is supplied to each of the second return spaces 5-2 of the return header 170. For example, the gas-liquid two-phase coolant having flown through the highest second inlet-side heat exchanger tube among the second inlet-side heat exchanger tubes 1-2*a* is supplied to the highest second return space 7 among the second return spaces 5-2. The gas-liquid two-phase coolant having flown through the lowest second inlet-side heat exchanger tube among the second inlet-side heat exchanger tubes 1-2*a* is supplied to the lowest second return space 11 among the second return spaces 5-2. The gas-liquid two-phase coolant having flown through the second lowest second inlet-side heat exchanger tube among the second inlet-side heat exchanger tubes 1-2*a* is supplied to the second lowest second return space 12 among the second return spaces 5-2.

The gas-liquid two-phase coolant having flown through the third inlet-side heat exchanger tubes 1-3*a* is supplied to each of the third return spaces 5-3 of the return header 170. For example, the gas-liquid two-phase coolant having flown through the highest third inlet-side heat exchanger tube among the third inlet-side heat exchanger tubes 1-3*a* is supplied to the highest third return space 14 among the third return spaces 5-3. The gas-liquid two-phase coolant having flown through the second highest third inlet-side heat exchanger tube among the third inlet-side heat exchanger tubes 1-3*a* is supplied to the second highest third return space 15 among the third return spaces 5-3. The gas-liquid two-phase coolant having flown through the lowest third inlet-side heat exchanger tube among the third inlet-side heat exchanger tubes 1-3*a* is supplied to the lowest third return space 16 among the third return spaces 5-3.

The gas-liquid two-phase coolant having flown through the fourth inlet-side heat exchanger tubes 1-4*a* is supplied to each of the fourth return spaces 5-4 of the return header 170. For example, the gas-liquid two-phase coolant having flown through the highest fourth inlet-side heat exchanger tube among the fourth inlet-side heat exchanger tubes 1-4*a* is supplied to the highest fourth return space 17 among the fourth return spaces 5-4. The gas-liquid two-phase coolant having flown through the second highest fourth inlet-side heat exchanger tube among the fourth inlet-side heat exchanger tubes 1-4*a* is supplied to the second highest fourth return space 18 among the fourth return spaces 5-4.

The gas-liquid two-phase coolant that is supplied to the first return space 6 that is the lowest (on the bottom side) among the first return spaces 5-1 and the gas-liquid two-phase coolant that is supplied to the second return space 7 that is the highest (on the top side) among the second return spaces 5-2 are mixed because the lowest first return space 6 among the first return spaces 5-1 and the highest second return space 7 among the second return spaces 5-2 communicate via the first coolant tube 21. The mixed gas-liquid two-phase coolant is supplied from the lowest first return space 6 among the first return spaces 5-1 to the lowest first outlet-side heat exchanger tube among the first outlet-side heat exchanger tubes 1-1*b* that are connected to the first return spaces 5-1 and is supplied from the highest second return space 7 among the second return spaces 5-2 to the highest second outlet-side heat exchanger tube among the second outlet-side heat exchanger tubes 1-2*b* that are connected to the second return spaces 5-2.

Similarly, the gas-liquid two-phase coolant that is supplied to each of the lowest second return space 11 and the second lowest second return space 12 among the second return spaces 5-2 and to the highest third return space 14 and the second highest third return space 15 among the third return spaces 5-3 is mixed via the second coolant tube 22. The gas-liquid two-phase coolant that is mixed via the second coolant tube 22 is supplied to the lowest second outlet-side heat exchanger tube and the second lowest second outlet-side heat exchanger tube that are connected to the second return spaces 5-2 and the highest third outlet-side heat exchanger tube and the second highest third outlet-side heat exchanger tube that are connected to the third return spaces 5-3. The gas-liquid two-phase coolant that is supplied to each of the lowest third return space 16 among the third return spaces 5-3 and the highest fourth return space 17 and the second highest fourth return space 18 among the fourth return spaces 5-4 is mixed via the third coolant tube 23. The gas-liquid two-phase coolant that is mixed via the third coolant tube 23 is supplied to the lowest third outlet-side heat exchanger tube that is connected to the third return spaces 5-3 and the highest fourth outlet-side heat exchanger tube and the second highest fourth outlet-side heat exchanger tube that are connected to the fourth return spaces 5-4.

The gas-liquid two-phase coolant that is supplied to a first return space different from the lowest first return space 6 among the first return spaces 5-1 is not mixed with other gas-liquid two-phase coolant and is directly supplied to the first outlet-side heat exchanger tube that is connected to that first return space among the first outlet-side heat exchanger tubes 1-1*b*. The gas-liquid two-phase coolant that is supplied to a second return space different from the highest second return space 7, the lowest second return space 11 and the second lowest second return space 12 among the second return spaces 5-2 is directly supplied to the second outlet-side heat exchanger tube that is connected to that second return space among the second outlet-side heat exchanger tubes 1-2*b*, too. The gas-liquid two-phase coolant that is supplied to a third return space different from the highest third return space 14, the second highest third return space 15 and the lowest third return space 16 among the third return spaces 5-3 is directly supplied to the third outlet-side heat exchanger tube that is connected to that third return space among the third outlet-side heat exchanger tubes 1-3*b*, too. The gas-liquid two-phase coolant that is supplied to a fourth return space different from the highest fourth return space 17 and the second highest fourth return space 18 among the fourth return spaces 5-4 is directly supplied to the fourth outlet-side heat exchanger tube that is connected to that fourth return space among the fourth outlet-side heat exchanger tubes 1-4*b*, too.

The air that flows outside the outlet-side heat exchanger tubes 111*b* and the gas-liquid two-phase coolant that flows through the outlet-side heat exchanger tubes 111*b* thermally make contact with the outlet-side heat exchanger tubes 111*b* and accordingly heat is exchanged mutually via the outlet-side heat exchanger tubes 111*b*. The air flowing outside the outlet-side heat exchanger tubes 111*b* is cooled by such heat exchange. As for the gas-liquid two-phase coolant flowing through the outlet-side heat exchanger tubes 111*b*, part of the liquid phase coolant of the gas-liquid two-phase coolant evaporates by such heat exchange and the dryness increases. The gas-liquid two-phase coolant having flown through the outlet-side heat exchanger tubes 111*b* is supplied to the outlet header 140 and flows to the outside via the outlet space 4 and the flow-out tube 150.

In a coolant with a high proportion of the gas phase (high dryness), the amount of coolant that can be vaporized is small and therefore the amount of latent heat that contributes to heat exchange with the air is small. In other words, when flow division is not performed with even proportions of the gas phase and the liquid phase, capability of heat exchange by the outlet-side heat exchanger tubes 111*b* through which the coolant with high dryness flows decreases and accordingly a decrease in the amount of heat exchange serving as a heat exchanger is caused. When the dryness of the gas-liquid two-phase coolant that is supplied to the outlet-side heat exchanger tubes 111*b* is high, the amount of heat exchange with the air lowers compared to the case where the dryness is low.

The heat exchanger 100 of the present embodiment is provided with the first coolant tube 21, the second coolant tube 22 and the third coolant tube 23 and therefore is capable of mixing the gas-liquid two-phase coolant with relatively large dryness after flowing through the inlet-side heat exchanger tubes 111*a* (for example, the coolant supplied to the highest second return space 7 among the second return spaces 5-2) and the gas-liquid two-phase coolant with relatively small dryness (for example, the coolant supplied to the lowest first return space 6 among the first return spaces 5-1). In the heat exchanger 100, the gas-liquid two-phase coolants with different dryness are mixed and therefore it is possible to supply the gas-liquid two-phase coolant with even dryness to each of the outlet-side heat exchanger tubes 111*b*. In the heat exchanger 100, because the gas-liquid two-phase coolant with even dryness flows through each of the outlet-side heat exchanger tubes 111*b* and accordingly is divided into the outlet-side heat exchanger tubes 111*b* with even proportions of the gas phase and the liquid phase, it is possible to inhibit the amount of heat exchange serving as a heat exchanger from decreasing. Furthermore, it is possible to appropriately cool the air that flows outside the outlet-side heat exchanger tubes 111*b*.

In operations serving as a condenser, the coolant flows in a direction opposite to that in the case of operations serving as an evaporator. In other words, in the heat exchanger 100, first of all, the gas single-phase coolant or the coolant in the gas-liquid two-phase state with sufficiently large dryness is supplied to the outlet space 4 of the outlet header 140. The coolant that is supplied to the outlet space 4 is supplied to the outlet-side heat exchanger tubes 111*b* and flows through the outlet-side heat exchanger tubes 111*b*. At that time, the coolant that is supplied to the outlet space 4 has sufficiently large dryness and therefore the dryness tends not to have imbalance because of the gravity. For this reason, dryness of the coolant that is supplied to each the outlet-side heat exchanger tubes 111*b* is approximately equal.

The air that flows outside the outlet-side heat exchanger tubes 111*b* and the coolant that flows through the outlet-side heat exchanger tubes 111*b* thermally make contact with the outlet-side heat exchanger tubes 111*b* and accordingly heat is exchanged mutually via the outlet-side heat exchanger tubes 111*b*. The coolant that flows through the outlet-side heat exchanger tubes 111*b* condenses partly by such heat exchange and dryness lowers. The air flowing outside the outlet-side heat exchanger tubes 111*b* is heated by such heat exchange.

The coolant having flown through each of the outlet-side heat exchanger tubes 111*b* is supplied to the return header 170 and is supplied to each of the spaces that are formed in the return header 170. At that time, the coolant that is supplied to the lowest first return space 6 among the first return spaces 5-1 and the coolant that is supplied to the highest second return space 7 among the second return spaces 5-2 are mixed because the first coolant tube 21 enables communication between the lowest first return space 6 among the first return spaces 5-1 and the highest second return space 7 among the second return spaces 5-2. Similarly, the coolant that is supplied to each of the lowest second return space 11 and the second lowest second return space 12 among the second return spaces 5-2 and to the highest third return space 14 and the second highest third return space 15 among the third return spaces 5-3 is mixed via the second coolant tube 22. The coolant that is supplied to each of the lowest third return space 16 among the third return spaces 5-3 and the highest fourth return space 17 and the second highest fourth return space 18 among the fourth return spaces 5-4 is mixed via the third coolant tube 23. Even when the coolant that is supplied to each of the spaces is mixed as described above, because the dryness is approximately equal originally, the dryness is approximately equal mutually.

The coolant that is supplied to each of the spaces is supplied to the inlet-side heat exchanger tubes 111*a* and flows through the inlet-side heat exchanger tubes 111*a*. The coolant that flows through the inlet-side heat exchanger tubes 111*a* and the air that flows outside the inlet-side heat exchanger tubes 111*a* thermally make contact with the inlet-side heat exchanger tubes 111*a* and accordingly heat is exchanged mutually via the inlet-side heat exchanger tubes 111*a*. The coolant that flows through the inlet-side heat exchanger tubes 111*a* further condenses because of such heat exchange and dryness further lowers. The air that flows outside the inlet-side heat exchanger tubes 111*a* is heated by such heat exchange. The gas-liquid two-phase coolant having flown through the inlet-side heat exchanger tubes 111*a* is supplied to the flow divider 3 via the first inlet space 2-1, the second inlet space 2-2, the third inlet space 2-3, the fourth inlet space 2-4 and the flow-in tube 130 and flows to the outside from the flow divider 3.

Accordingly, in the case where the heat exchanger 100 is used as a condenser, even when the first coolant tube 21, the second coolant tube 22 and the third coolant tube 23 are provided in the return header 170, it is possible to appropriately lower the dryness of the coolant and enable appropriate operations as a condenser.

Effect of Heat Exchanger 100 of First Embodiment

The heat exchanger 100 of the first embodiment includes the inlet header 120, the inlet-side heat exchanger tubes 111*a*, the outlet-side heat exchanger tubes 111*b* and the return header 170. The first inlet space 2-1 and the second inlet space 2-2 are formed in the inlet header 120. The inlet-side heat exchanger tubes 111*a* contains the first inlet-side heat exchanger tubes 1-1*a* that are connected to the first inlet space 2-1 and the second inlet-side heat exchanger tubes 1-2*a* that are connected to the second inlet space 2-2. The outlet-side heat exchanger tubes 111*b* contain the first outlet-side heat exchanger tubes 1-1*b* and the second outlet-side heat exchanger tubes 1-2*b*. In the return header 170, the first return spaces 5-1 that enable the first inlet-side heat exchanger tubes 1-1*a* to communicate with the first outlet-side heat exchanger tubes 1-1*b*, respectively, and the second return spaces 5-2 that enable the second inlet-side heat exchanger tubes 1-2*a* to communicate with the second outlet-side heat exchanger tubes 1-2*b*, respectively, are formed. The lowest first return space 6 among the first return spaces 5-1 is connected to the lowest first inlet-side heat exchanger tube that is arranged on the bottom side among the first inlet-side heat exchanger tubes 1-1*a*. The highest second return space 7 among the second return spaces 5-2 is connected to the highest second inlet-side heat exchanger tube that is arranged on the top side among the second inlet-side heat exchanger tubes 1-2*a*. In the return header 170, the first coolant tube 21 enabling communication between the lowest first return space 6 and the highest second return space 7 is further formed.

The heat exchanger 100 of the first embodiment further includes the flow divider 3 that supplies the coolant in the gas-liquid two-phase state to the first inlet space 2-1 and the second inlet space 2-2. In the heat exchanger 100, when the coolant in the gas-liquid two-phase state is supplied to the first inlet space 2-1 and the second inlet space 2-2, the coolant with larger dryness is supplied to the first inlet-side heat exchanger tube on the upper side and the coolant with larger dryness is supplied to the second inlet-side heat exchanger tube on the upper side. For this reason, the dryness of the coolant having flown through the highest second inlet-side heat exchanger tube may be larger than the dryness of the coolant having flown through the lowest first inlet-side heat exchanger tube. In the heat exchanger 100, because the first coolant tube 21 is provided, it is possible to mix the coolant having flown through the highest second inlet-side heat exchanger tube and the coolant having flown through the lowest first inlet-side heat exchanger tube and it is possible to supply the gas-liquid two-phase coolant with even dryness to the outlet-side heat exchanger tubes 111*b*. In the heat exchanger 100, because the gas-liquid two-phase coolant with even dryness flows through each of the outlet-side heat exchanger tubes 111*b*, which makes it possible to inhibit the amount of heat exchange serving as the heat exchanger from lowering.

The heat exchanger 100 according to the first embodiment includes the flow divider 3, and the flow divider 3 may be omitted. In the heat exchanger 100, even when the flow divider 3 is omitted, because flow division to the outlet-side heat exchanger tube with even proportions of the gas phase and the liquid phase is performed, it is possible to inhibit the amount of heat exchange serving as the heat exchanger from lowering.

The first coolant tube 21 of the heat exchanger 100 of the above-described first embodiment mixes the coolant that is supplied to the two spaces that are formed in the return header 170 and, like the second coolant tube 22 and the third coolant tube 23, the first coolant tube 21 may mix the coolant that is supplied to the three or more spaces. Also in that case, in the heat exchanger 100, because flow division to the outlet-side heat exchanger tube with even proportions of the gas phase and the liquid phase is performed, it is possible to inhibit the amount of heat exchange serving as the heat exchanger from lowering.

The number of the inlet-side heat exchanger tubes that are connected to the first inlet space 2-1 among the inlet-side heat exchanger tubes 111*a* of the heat exchanger 100 of the first embodiment is smaller than the number of the inlet-side heat exchanger tubes that are connected to each of the second inlet space 2-2, the third inlet space 2-3 and the fourth inlet space 2-4. For this reason, the vertical length of the first inlet space 2-1 can be shorter than that of the second inlet space 2-2, the third inlet space 2-3 and the fourth inlet space 2-4. The first inlet space 2-1 on the top side is an inlet space in which the proportion of the gas phase is the highest and unevenness in dryness of the coolant tends to occur relatively due to the effect of the gravity. For this reason, reducing the vertical length of the first inlet space 2-1 makes it possible to reduce imbalance in dryness of the coolant in the first inlet-space 2-1 and reduce imbalance in dryness of the gas-liquid two-phase coolant that is supplied to the first inlet-side heat exchanger tubes 1-1*a* that are connected to the first inlet space 2-1.

The outlet-side heat exchanger tubes 111*b* of the heat exchanger 100 of the first embodiment are arranged along the inlet-side heat exchanger tubes 111*a*; however, outlet-side heat exchanger tubes 111*b* need not be along the inlet-side heat exchanger tubes 111*a*.

Second Embodiment

Figure 9:
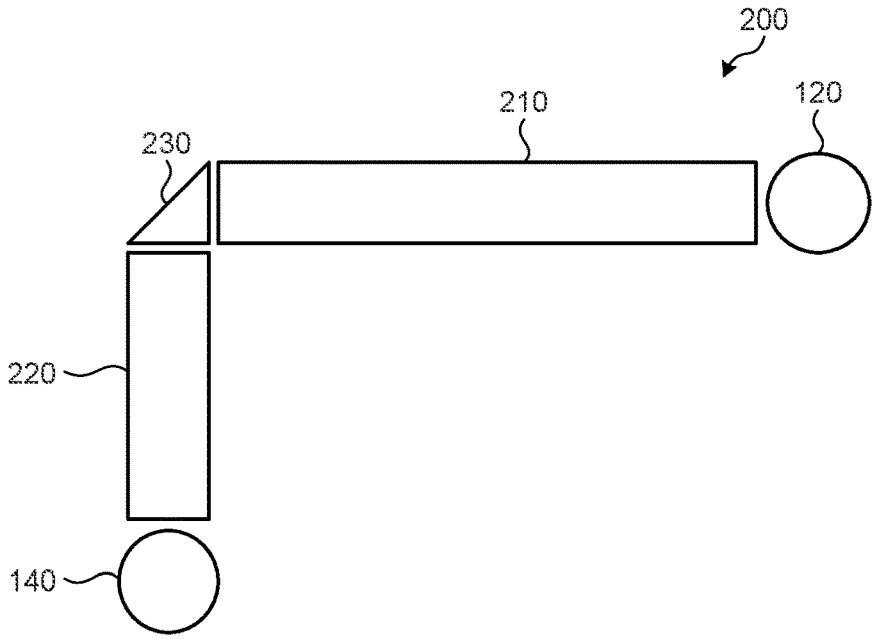
FIG. 9 is a schematic diagram illustrating a heat exchanger of a second embodiment.

FIG. 9 is a schematic diagram illustrating a heat exchanger 200 of a second embodiment. In the heat exchanger 200, the heat exchange core 110 of the heat exchanger 100 of the above-described first embodiment is replaced with a plurality of inlet-side cores 210 and a plurality of outlet-side cores 220. The inlet-side cores 210 are formed of the inlet-side heat exchanger tube 111*a* and the inlet-side fins 112*a* that are described above. The outlet-side cores 220 are formed of the outlet-side heat exchanger tubes 111*b* and the outlet-side fins 112*b* that are described above. The outlet-side cores 220 are arranged along another plane perpendicular to the plane along which the inlet-side cores 210 are and are arranged not along the inlet-side cores 210.

In the heat exchanger 200, furthermore, the return header 170 of the heat exchanger 100 of the first embodiment described above is replaced with another header 230. In the header 230, as in the return header 170 described above, the first return spaces 5-1, the second return spaces 5-2, the third return spaces 5-3 and the fourth return spaces 5-4 are formed. Furthermore, like the above-described return header 170, the header 230 is provided with the first coolant tube 21, the second coolant tube 22 and the third coolant tube 23 in which the first communication path, the second communication path and the third communication path are formed.

The heat exchanger 200 operates like the heat exchanger 100 of the first embodiment described above. In the heat exchanger 200, even when the outlet-side cores 220 are not along the inlet-side cores 210, as in the heat exchanger 100 of the first embodiment, because flow division to the outlet-side heat exchanger tube with even proportions of the gas phase and the liquid phase is performed, it is possible to inhibit the amount of heat exchange serving as the heat exchanger from lowering.

In the return headers 170 and 230 described above, the first communication path is formed by providing the first coolant tube 21, and the first communication path may be formed without the first coolant tube 21. For example, in the return header 170, the first communication path enabling communication between the lowest first return space 6 and the highest second return space 7 may be formed by forming a concave portion in each of the platy member 171 and the platy member 172. Similarly, in the return header 170, the second communication path enabling communication of the lowest second return space 11, the second lowest second return space 12, the highest third return space 14 and the second highest third return space 15 may be formed by concave portions in the platy member 171 and the platy member 172. Similarly, in the return header 170, the third communication path enabling communication of the lowest third return space 16, the highest fourth return space 17, the second highest fourth return space 18 may be formed by concave portions in the platy member 171 and the platy member 172. In the heat exchanger, when such a return header is provided, similarly, it is possible to inhibit the amount of heat exchange from lowering.

The embodiments have been described above and the above-described content does not limit the embodiments. The components described above include those easily assumable by those skilled in the art, those substantially the same, that is, those within the range of equivalency. Furthermore, the above-described components can be combined as appropriate. Furthermore, at least one of various omissions, replacements and changes of the components can be made within the scope of the embodiments.

REFERENCE SIGNS LIST

100 HEAT EXCHANGER
110 HEAT EXCHANGE CORE
111*a* INLET-SIDE HEAT EXCHANGER TUBE
111*b* OUTLET-SIDE HEAT EXCHANGER TUBE
112*a* INLET-SIDE FIN
112*b* OUTLET-SIDE FIN
120 INLET HEADER
130 FLOW-IN TUBE
140 OUTLET HEADER
150 FLOW-OUT TUBE
170 RETURN HEADER
1-1 FIRST HEAT EXCHANGER UNIT
1-2 SECOND HEAT EXCHANGER UNIT
1-3 THIRD HEAT EXCHANGER UNIT
1-4 FOURTH HEAT EXCHANGER UNIT
2-1 FIRST INLET SPACE
2-2 SECOND INLET SPACE
2-3 THIRD INLET SPACE
2-4 FOURTH INLET SPACE
3 FLOW DIVIDER
5-1 FIRST RETURN SPACES
5-2 SECOND RETURN SPACES
5-3 THIRD RETURN SPACES
5-4 FOURTH RETURN SPACES
6 LOWEST FIRST RETURN SPACE
7 HIGHEST SECOND RETURN SPACE
11 LOWEST SECOND RETURN SPACE
12 SECOND LOWEST SECOND RETURN SPACE
14 HIGHEST THIRD RETURN SPACE
15 SECOND HIGHEST THIRD RETURN SPACE
16 LOWEST THIRD RETURN SPACE
17 HIGHEST FOURTH RETURN SPACE
18 SECOND HIGHEST FOURTH RETURN SPACE
21 FIRST COOLANT TUBE
22 SECOND COOLANT TUBE
23 THIRD COOLANT TUBE
200 HEAT EXCHANGER
210 INLET-SIDE CORES
220 OUTLET-SIDE CORES
230 HEADER

The invention claimed is:

1. A heat exchanger comprising:

an inlet header in which a plurality of inlet spaces including a first inlet space and a second inlet space adjacent to and under the first inlet space are formed;

a plurality of inlet-side heat exchanger tubes that includes a plurality of first inlet-side heat exchanger tubes that are connected to the first inlet space and that are aligned vertically and a plurality of second inlet-side heat exchanger tubes that are connected to the second inlet space and that are aligned vertically;

a return header in which a plurality of return spaces that are connected to the inlet-side heat exchanger tubes, respectively, are formed, the return spaces including a plurality of first return spaces that are connected to the first inlet-side heat exchanger tubes, respectively, and that are aligned vertically and a plurality of second return spaces that are connected to the second inlet-side heat exchanger tubes, respectively, and that are aligned vertically; and a plurality of outlet-side heat exchanger tubes that are connected to the return spaces, respectively, and that are aligned vertically, wherein a communication path that enables a first return space on a bottom side among the first return spaces and a second return space on a top side among the second return spaces to communicate is further formed in the return header, the first return space on the bottom side is isolated from a plurality of return spaces different from the second return space on the top side among the plurality of return spaces, the second return space on the top side is isolated from a plurality of return spaces different from the first return space on the bottom side among the plurality of return spaces, and the plurality of return spaces other than the first return space on the bottom side and the second return space on the top side among the plurality of return spaces are isolated from one another.

2. The heat exchanger according to claim 1, wherein a total number of the return spaces is equal to a total number of the inlet-side heat exchanger tubes.

3. The heat exchanger according to claim 1, wherein the inlet-side heat exchanger tubes are arranged along the outlet-side heat exchanger tubes.

4. The heat exchanger according to claim 1, wherein the inlet spaces include a top side inlet space and another inlet space that is arranged under the top side inlet space, and the number of inlet-side heat exchanger tubes that are connected to the top side inlet space among the inlet-side heat exchanger tubes is smaller than the number of inlet-side heat exchanger tubes that are connected to the another inlet space among the inlet-side heat exchanger tubes.

* * * * *